US008740661B2

(12) United States Patent
Inoue

(10) Patent No.: US 8,740,661 B2
(45) Date of Patent: Jun. 3, 2014

(54) MARINE PROPULSION DEVICE

(75) Inventor: Hiroshi Inoue, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 0 days.

(21) Appl. No.: 13/438,953

(22) Filed: Apr. 4, 2012

(65) Prior Publication Data

US 2012/0282828 A1 Nov. 8, 2012

(30) Foreign Application Priority Data

May 2, 2011 (JP) ..... 2011-103056

(51) Int. Cl.
*B63H 21/21* (2006.01)

(52) U.S. Cl.
USPC ..... 440/86

(58) Field of Classification Search
USPC ..... 440/86, 89, 3
See application file for complete search history.

(56) References Cited

U.S. PATENT DOCUMENTS

| | | | | |
|---|---|---|---|---|
| 4,728,308 | A * | 3/1988 | Weismann | 440/57 |
| 6,361,385 | B1 * | 3/2002 | Bland et al. | 440/6 |
| 6,881,110 | B1 * | 4/2005 | Abdel-Maksoud et al. | 440/89 R |
| 6,887,014 | B2 * | 5/2005 | Holland | 405/184.1 |
| 7,690,956 | B2 * | 4/2010 | Ito et al. | 440/1 |
| 7,867,048 | B2 * | 1/2011 | Ochiai | 440/89 H |
| 7,931,513 | B2 * | 4/2011 | Suzuki et al. | 440/86 |
| 8,002,597 | B2 * | 8/2011 | Ochiai | 440/89 H |
| 8,011,985 | B2 * | 9/2011 | Ochiai | 440/89 H |
| 8,118,631 | B2 * | 2/2012 | Ochiai | 440/89 H |
| 8,277,270 | B2 * | 10/2012 | Ryuman | 440/86 |
| 2003/0106364 | A1 | 6/2003 | Kimata et al. | |
| 2008/0268726 | A1 | 10/2008 | Akuzawa | |
| 2012/0028514 | A1 * | 2/2012 | Grassi et al. | 440/3 |

FOREIGN PATENT DOCUMENTS

| | | |
|---|---|---|
| JP | 2003-120397 A | 4/2003 |
| JP | 2008-274970 A | 11/2008 |

* cited by examiner

*Primary Examiner* — Lars A Olson
*Assistant Examiner* — Jovon Hayes
(74) *Attorney, Agent, or Firm* — Keating & Bennett, LLP

(57) ABSTRACT

A marine propulsion device includes an engine, a propeller, a drive shaft, an exhaust path, a water intrusion detecting portion and a recording portion. The drive shaft is configured to transmit driving force from the engine to the propeller. The exhaust path allows exhaust air from the engine to pass therethrough. The water intrusion detecting portion is configured to detect a water intrusion potential indicating a possibility of water intrusion into the engine through the exhaust path. The recording portion is configured to record a detection result of the water intrusion detecting portion.

22 Claims, 8 Drawing Sheets

MARINE PROPULSION DEVICE

CROSS-REFERENCE TO RELATED APPLICATIONS

This application claims priority to Japanese Patent Application No. 2011-103056 filed on May 2, 2011, the entirety of which is hereby incorporated by reference in its entirety.

BACKGROUND OF THE INVENTION

1. Field of the Invention

The present invention relates to a marine propulsion device.

2. Description of the Related Art

In marine propulsion devices such as the outboard motors, a drive shaft and a propeller are coupled through a rearward travel gear when a shift lever is shifted to a rearward travel position during high speed navigation. However, when the propeller is coupled to the rearward travel gear, the propeller can be rotated by a water stream passing through the propeller in a forward travel direction. Accordingly, the engine is reversely rotated. Marine propulsion devices are normally configured to discharge exhaust gas from the engine into the water through an exhaust path. Therefore, reverse rotation of the engine causes a phenomenon of inhaling water into the engine through the exhaust path. Such water intrusion into the engine may damage or break the engine.

Japan Laid-open Patent Application Publication No. JP-A-2003-120397 describes a device configured to count an angle signal of a crankshaft and detect reverse rotation of the crankshaft in accordance with the counted values. Further, the device is configured to stop ignition and fuel supply when detecting reverse rotation of the crankshaft. Thus, water intrusion into the engine is prevented by stopping the engine.

Further, Japan Laid-open Patent Application Publication No. JP-A-2008-274970 describes a device configured to detect reverse rotation of a crankshaft by detecting a crankshaft rotational angle and a cam shaft rotational angle. The device is configured to forcibly shift a forward/rearward travel switching gear to a neutral position when detecting reverse rotation of the crankshaft. Accordingly, water intrusion into the engine is prevented.

According to the device of Japan Laid-open Patent Application Publication No. JP-A-2003-120397, the propeller is rotated by the water stream even when ignition is stopped. Accordingly, reverse rotation of the crankshaft is continued. Therefore, prevention of water intrusion into the engine is relatively ineffective. According to the device of Japan Laid-open Patent Application Publication No. JP-A-2008-274970, on the other hand, the crankshaft may be continuously reversely rotated until the gear is completely shifted to the neutral position. In addition, reverse rotation of the crankshaft may be continued due to an inertial force for a while even after the gear is completely shifted to the neutral position. Therefore, prevention of water intrusion into the engine is limited. In view of the above, both devices described in the above-identified publications can prevent a large amount of water intrusion into the engine but cannot completely prevent water intrusion into the engine. In other words, both devices cannot prevent a small amount of water intrusion into the engine. When a small amount of water intrudes into the engine, the engine may be damaged or broken due to its corrosion after the elapse of a long period of time, even if the engine is not be immediately damaged or broken.

SUMMARY OF THE INVENTION

In order to overcome the problems described above, preferred embodiments of the present invention provide a marine propulsion device that prevents damage and breakage of the engine due to water intrusion.

A marine propulsion device according to a preferred embodiment of the present invention includes an engine, a propeller, a drive shaft, an exhaust path, a water intrusion detecting portion, and a recording portion. The drive shaft is configured to transmit a driving force from the engine to the propeller. The exhaust path allows exhaust air from the engine to pass therethrough. The water intrusion detecting portion is configured to detect a water intrusion potential indicating a possibility of water intrusion into the engine through the exhaust path, and is thus configured as a water intrusion possibility determining portion. The recording portion is configured to record a detection result of the water intrusion detecting portion.

A marine propulsion device according to another preferred embodiment of the present invention includes an engine, a propeller, a drive shaft, an exhaust path, a water intrusion detecting portion, and a notifying portion. The drive shaft is configured to transmit a driving force from the engine to the propeller. The exhaust path allows exhaust air from the engine to pass therethrough. The water intrusion detecting portion is configured to detect a state of being prone to water intrusion into the engine through the exhaust path, that is, a state having a tendency or likelihood of water intrusion. The notifying portion is configured to perform a notifying action in accordance with a detection result by the water intrusion detecting portion.

According to the marine propulsion device of a first preferred embodiment of the present invention, when the water intrusion detecting portion detects the water intrusion potential, the recording portion is configured to record the detection result. Therefore, water intrusion potential can be obtained by examining the record stored in the recording portion at the time of maintenance without disassembling the engine. Thus, repair and inspection can thereby be executed while the engine is in a normal condition, and breakage or damage of the engine can thereby be prevented.

According to the marine propulsion device of a second preferred embodiment of the present invention, when the water intrusion detecting portion detects the state of being prone to water intrusion, the notifying portion is configured to provide notification of the detection result. Therefore, an operator is alerted by the notification of the notifying portion, and can avoid a type of operation that might cause water intrusion. Thus, water intrusion into the engine can be prevented, and breakage or damage of the engine can thereby be prevented.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

First Preferred Embodiment

Figure 1:
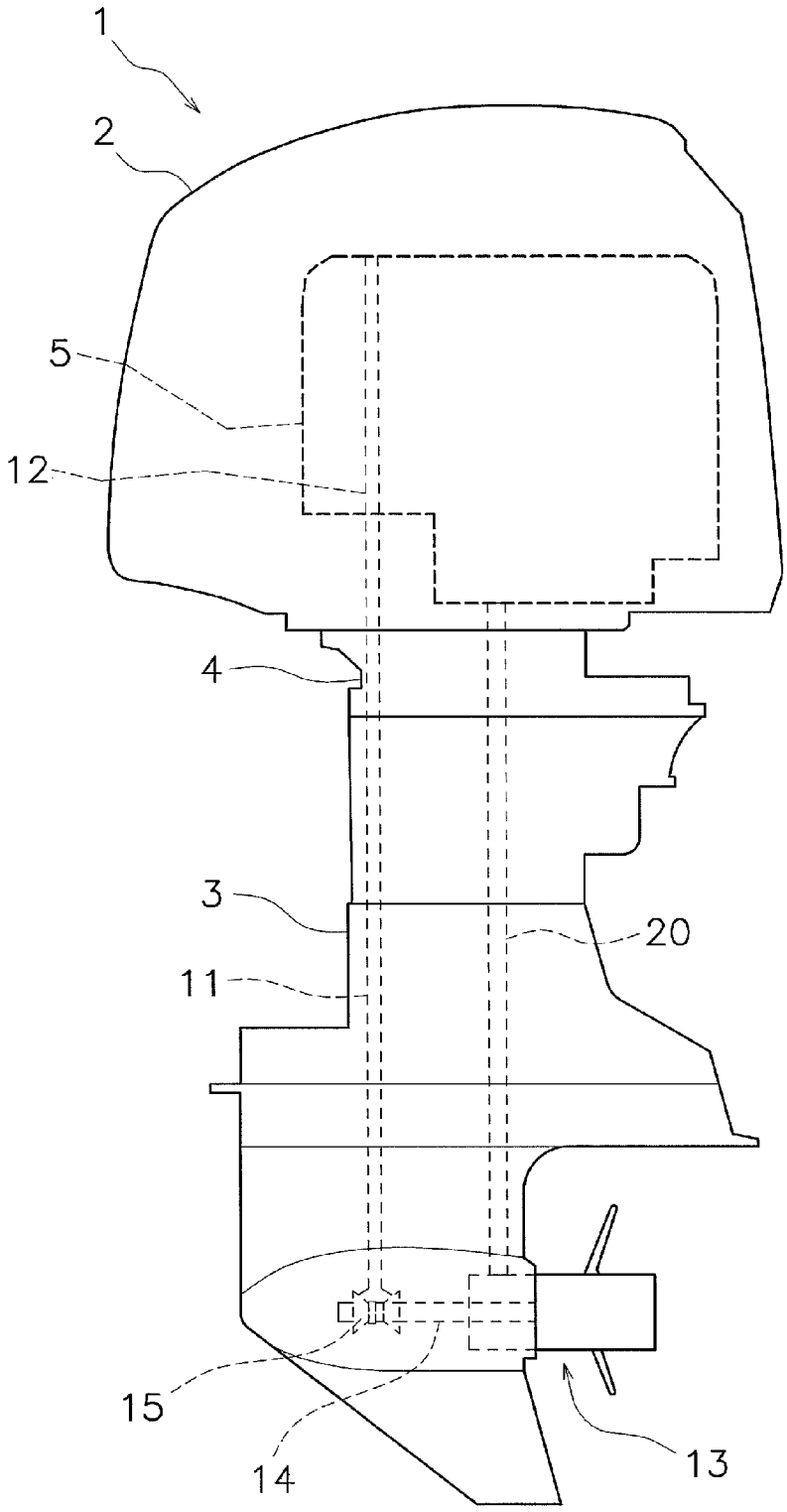
FIG. 1 is a side view of a marine propulsion device according to a preferred embodiment of the present invention.

A marine propulsion device according to a preferred embodiment of the present invention will be hereinafter explained with reference to the attached drawings. In the present preferred embodiment, a marine propulsion device preferably is an outboard motor. However, the present invention can be applied to the other types of the marine propulsion devices such as an inboard/outboard motor. FIG. 1 is a side view of a marine propulsion device 1 according to a first preferred embodiment of the present invention. The marine propulsion device 1 includes a top casing 2, a bottom casing 3, an exhaust guide 4, and an engine 5. The top casing 2, the bottom casing 3, and the engine 5 are fixed to the exhaust guide 4.

The engine 5 is disposed within the top casing 2. The engine 5 includes a crankshaft 12. A drive shaft 11 is disposed within the bottom casing 3. The drive shaft 11 is disposed within the bottom casing 3 along a vertical (up-and-down) direction. The drive shaft 11 is coupled to the crankshaft 12 of the engine 5. Further, a propeller 13 is disposed in the lower portion of the bottom casing 3. The propeller 13 is disposed below the engine 5. A propeller shaft 14 is coupled to the propeller 13. The propeller shaft 14 is disposed along a longitudinal (front-to back) direction of the marine propulsion device 1. The propeller shaft 14 is coupled to the bottom end of the drive shaft 11 through a forward/rearward travel switching portion 15.

Figure 2A:
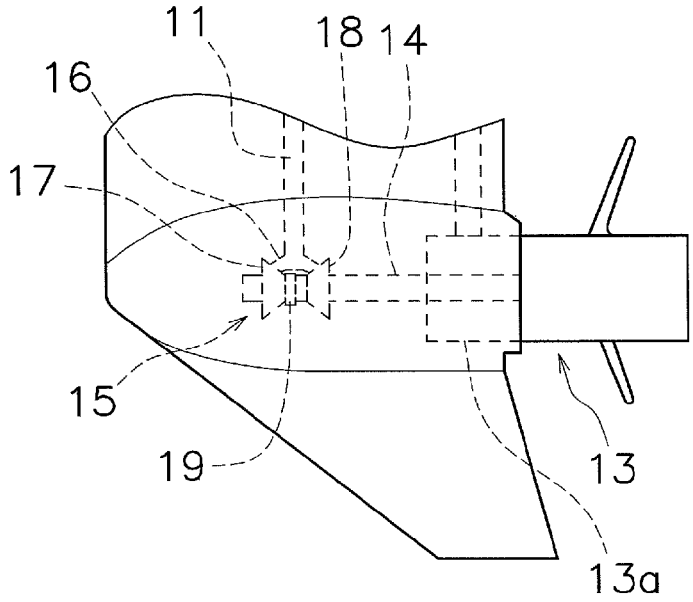
FIGS. 2A and 2B are structural side views of a forward/rearward travel switching portion of the marine propulsion device.
Figure 2B:
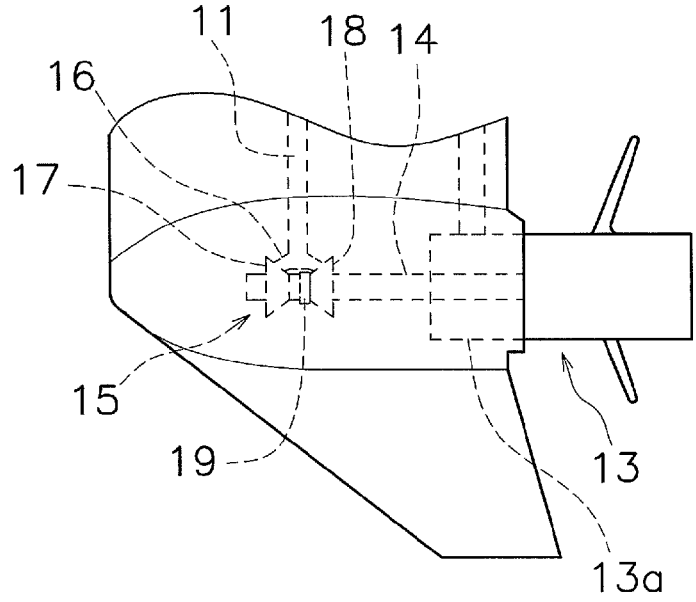

As illustrated in FIG. 2, the forward/rearward travel switching portion 15 includes a pinion gear 16, a forward travel gear 17, a rearward travel gear 18, and a dog clutch 19. The pinion gear 16 is coupled to the drive shaft 11. The pinion gear 16 is meshed with the forward travel gear 17 and the rearward travel gear 18. The forward travel gear 17 and the rearward travel gear 18 are attached to the propeller shaft 14 while being rotatable relative thereto. The dog clutch 19 is attached to the propeller shaft 14 while being non-rotatable relative thereto. Further, the dog clutch 19 is allowed to move among a forward travel position, a rearward travel position, and a neutral position along the axial direction of the propeller shaft 14. Specifically, a shift actuator 54 to be described below is configured to move the dog clutch 19 among the forward travel position, the rearward travel position, and the neutral travel position. In the forward travel position illustrated in FIG. 2A, the dog clutch 19 is configured to lock the forward travel gear 17 and the propeller shaft 14 in a relative non-rotatable state. In this case, rotation of the drive shaft 11 is transmitted to the propeller shaft 14 through the forward travel gear 17. In other words, the forward/rearward travel switching portion 15 is in a forward travel state to transmit rotation of the drive shaft 11 to the propeller 13 to rotate the propeller 13 in a forward direction. Accordingly, the propeller 13 is rotated in a direction causing the vessel body to travel forwards. In the rearward travel position illustrated in FIG. 2B, by contrast, the dog clutch 19 is configured to lock the rearward travel gear 18 and the propeller shaft 14 in a relative non-rotatable state. In this case, rotation of the drive shaft 11 is transmitted to the propeller shaft 14 through the rearward travel gear 18. In other words, the forward/rearward travel switching portion 15 is in a rearward travel state to transmit rotation of the drive shaft 11 to the propeller 13 to rotate the propeller 13 in a rearward direction. Accordingly, the propeller 13 is rotated in a direction causing the vessel body to travel rearwards. Further, when the dog clutch 19 is positioned in the neutral position between the forward travel position and the rearward travel position, the forward travel gear 17 and the rearward travel gear 18 are respectively rotatable relative to the propeller shaft 14. In other words, rotation of the drive shaft 11 is prevented from being transmitted to the propeller shaft 14, and the propeller shaft 14 is thus allowed to run idle.

In the marine propulsion device 1, a driving force generated by the engine 5 is configured to be transmitted to the propeller 13 through the drive shaft 11 and the propeller shaft 14. Accordingly, the propeller 13 is rotated in either the forward travel direction or the rearward travel direction. As a result, a propulsion force is generated to cause the vessel body including the marine propulsion device 1 to travel forwards or rearwards.

As illustrated in FIG. 1, an exhaust path 20 is arranged within the marine propulsion device 1. The exhaust path 20 extends downwardly from the engine 5. One end of the exhaust path 20 is connected to an exhaust port of the engine 5, while the other end of the exhaust path 20 communicates with the inner space of a propeller boss 13*a* of the propeller 13. Exhaust gas from the engine 5 is discharged into the water sequentially through the exhaust path 20 and the inner space of the propeller boss 13*a*.

Figure 3:
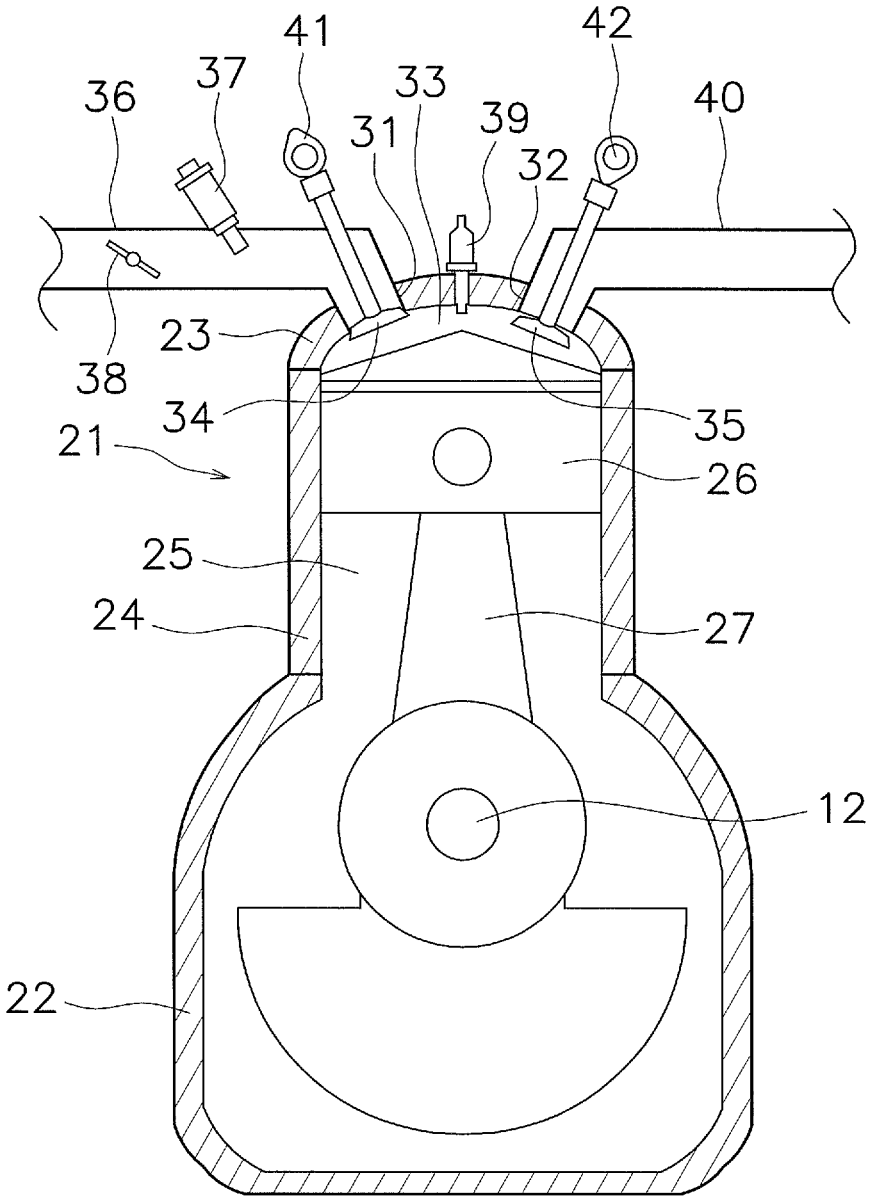
FIG. 3 is a structural top view of the inside of an engine.

FIG. 3 is a schematic top view of the internal structure of the engine 5. In the present preferred embodiment, the engine 5 includes a crankcase 22 and a plurality of cylinders 21. The number of the cylinders 21 and the arrangement thereof may be arbitrarily determined. The structure of a single cylinder 21 of the engine 5 will be hereinafter explained with reference to FIG. 3. It should be noted that all of the cylinders 21 of the engine 5 have the same structure as the one illustrated in FIG. 3. Each cylinder 21 includes a cylinder head 23 and a cylinder block 24. The cylinder head 23 is attached to the cylinder block 24. The cylinder block 24 includes a cylinder chamber 25 in the inside thereof. A piston 26 is disposed within the cylinder chamber 25 while being movable in the axial direction of the cylinder chamber 25. An end of a connecting rod 27 (hereinafter referred to as "a conrod 27") is coupled to the piston 26, whereas the other end of the conrod 27 is coupled to the crankshaft 12.

The cylinder head 23 includes an intake port 31, an exhaust port 32, and a combustion chamber 33. The intake port 31 and the exhaust port 32 communicate with the combustion chamber 33. The intake port 31 is configured to be opened or closed by an intake valve 34. The exhaust port 32 is configured to be opened or closed by an exhaust valve 35. An intake manifold 36 is connected to the intake port 31. Further, a fuel injector 37 is attached to the intake manifold 36. The fuel injector 37 is configured to inject fuel to be supplied to the combustion chamber 33. A throttle valve 38 is disposed in the intake manifold 36. The opening degree of the throttle valve 38 is configured to be changed to regulate the amount of mixed air and gas to be supplied to the combustion chamber 33. On the other hand, an exhaust manifold 40 is connected to the exhaust port 32. An ignition device 39 is attached to the cylinder head 23. The ignition device 39 is inserted into the combustion chamber 33 to ignite the fuel therein.

The intake valve 34 is urged in a direction of closing the intake port 31 by an urging member such as a coil spring (not illustrated in the figures). The intake valve 34 is configured to be opened or closed by rotational driving of an intake cam shaft 41. On the other hand, the exhaust valve 35 is urged in a direction of closing the exhaust port 32 by an urging member such as a coil spring (not illustrated in the figures). The exhaust valve 35 is configured to be opened or closed by rotational driving of an exhaust cam shaft 42.

Figure 4:
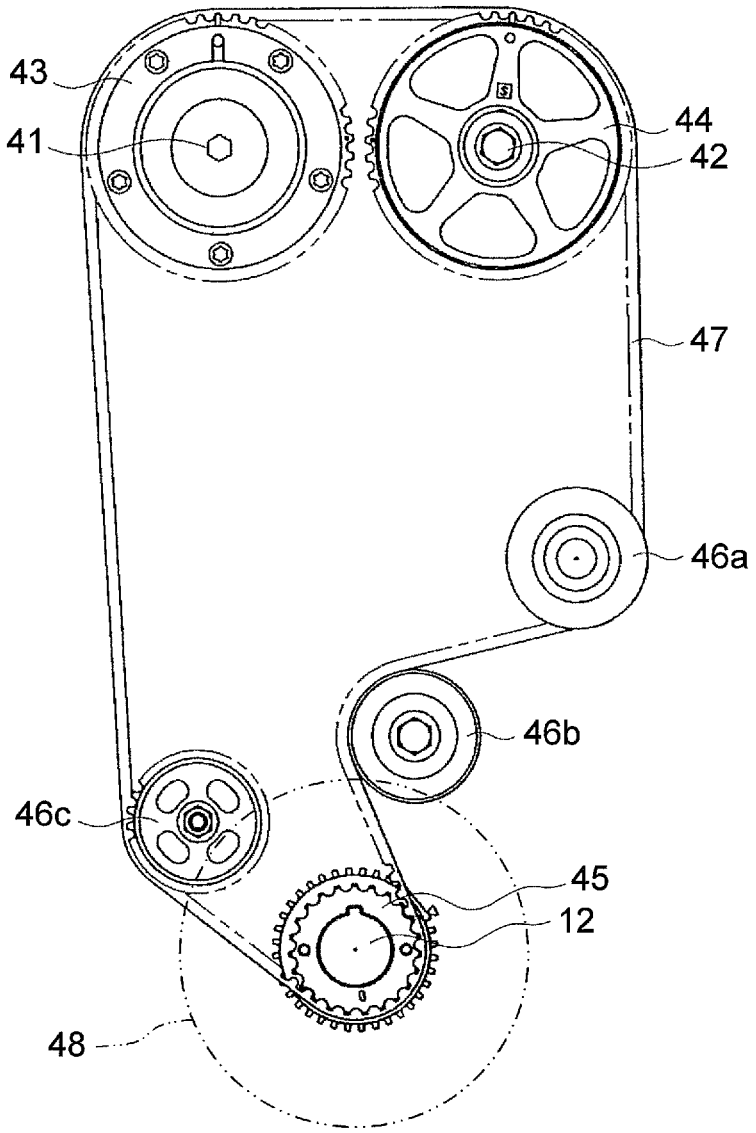
FIG. 4 is a structural top view of a drive mechanism of a cam shaft.

FIG. 4 is a top view of a drive mechanism configured to rotationally drive the intake cam shaft 41 and the exhaust cam shaft 42. For example, the drive mechanism is disposed on the top surface of the engine 5. As illustrated in FIG. 4, an intake cam pulley 43 is fixed to an end of the intake cam shaft 41, whereas an exhaust cam pulley 44 is fixed to an end of the exhaust cam shaft 42. A crank pulley 45 is fixed to the crankshaft 12. A cam belt 47 is wrapped around the intake cam pulley 43, the exhaust cam pulley 44, the crank pulley 45, and a plurality of intermediate pulleys 46*a*, 46*b* and 46*c*. Driving force of the crankshaft 12 is transmitted to the intake cam shaft 41 and the exhaust cam shaft 42 through the cam belt 47. It should be noted that a flywheel 48 is fixed to an end of the crankshaft 12.

Figure 5:
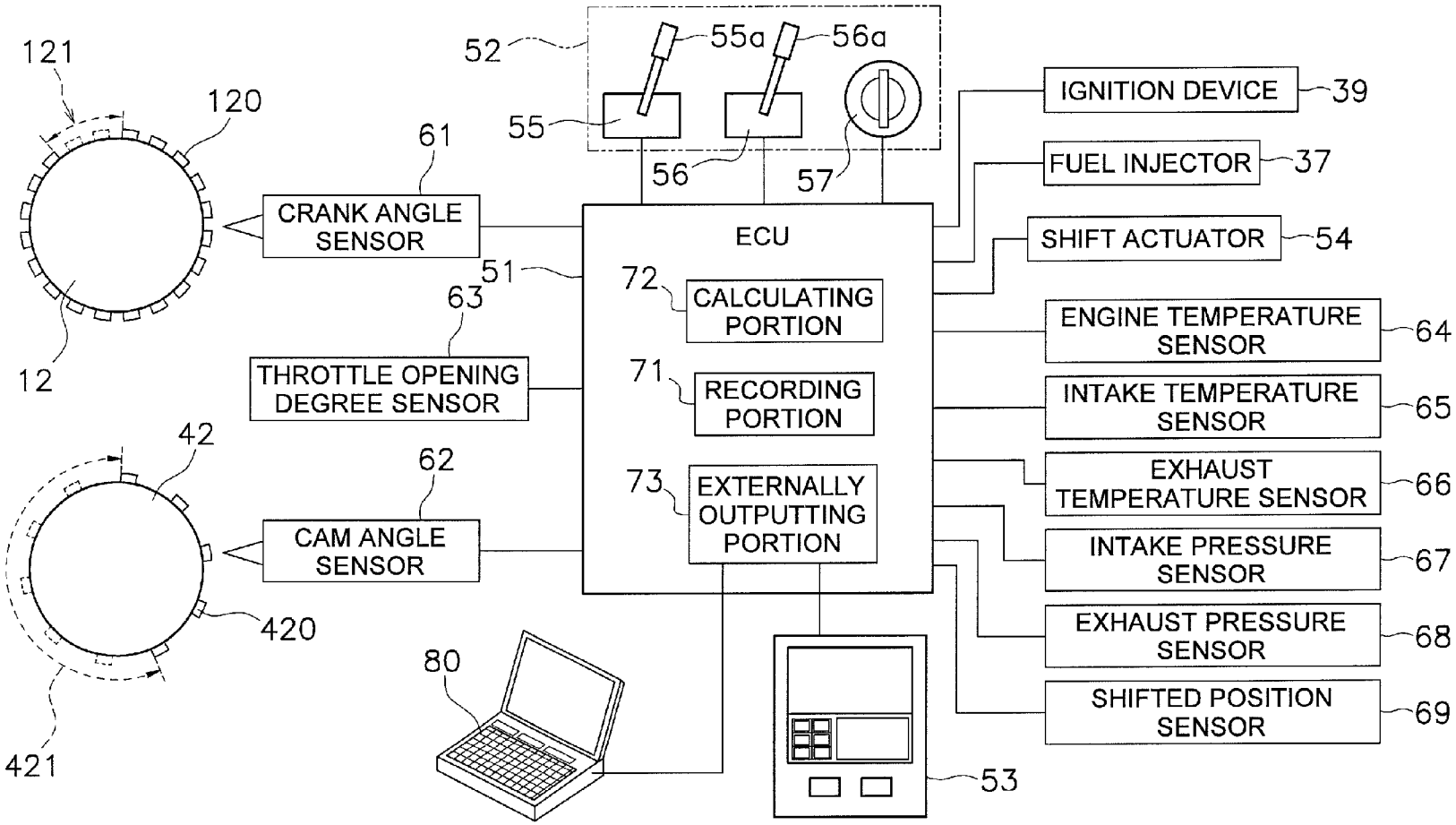
FIG. 5 is a schematic configuration diagram of a control system of an engine.

FIG. 5 is a schematic configuration diagram of a control system of the engine 5. The engine 5 is configured to be controlled by an ECU (Engine Control Unit) 51. A variety of sensors (61 to 69) to detect a variety of status information of the engine 5, an operating unit 52, and a display unit 53 are connected to the ECU 51. Specifically, the sensors connected to the ECU 51 include a crank angle sensor 61, a cam angle sensor 62, a throttle opening degree sensor 63, an engine temperature sensor 64, an intake temperature sensor 65, an exhaust temperature sensor 66, an intake pressure sensor 67, an exhaust pressure sensor 68, a shifted position sensor 69 and so forth. The crank angle sensor 61 is configured to detect the rotational angle of the crankshaft 12. The cam angle sensor 62 is configured to detect the rotational angle of the exhaust cam shaft 42. The throttle opening degree sensor 63 is configured to detect the opening degree of the throttle valve 38. The engine temperature sensor 64 is configured to detect the temperature of the engine 5. The intake temperature sensor 65 is configured to detect the temperature within the intake manifold 36. The exhaust temperature sensor 66 is configured to detect the temperature within the exhaust manifold 40. The intake pressure sensor 67 is configured to detect the pressure within the intake manifold 36. The exhaust pressure sensor 68 is configured to detect the pressure within the exhaust manifold 40. The shifted position sensor 69 is configured to detect the switched state of the forward/rearward travel switching portion 15 (i.e., the forward travel state, the rearward travel state, or the neutral state). For example, the shifted position sensor 69 is configured to detect the position of the dog clutch 19 in order to detect the switched state of the forward/rearward travel switching portion 15. Each of the aforementioned sensors is configured to input a detection signal into the ECU 51.

The operating unit 52 includes a throttle operating device 55, a shift operating device 56, and a start/stop operating device 57 for the engine 5. The throttle operating device 55 includes, for instance, a throttle operating member 55*a* such as a throttle lever. The throttle operating device 55 is configured to input an operating signal into the ECU 51 in response to an operation of the throttle operating member 55*a* in order to control an output of the engine 5. On the other hand, the shift operating device 56 includes, for instance, a shift operating member 56*a* such as a shift lever. The shift operating device 56 is configured to input an operating signal into the ECU 51 in response to an operation of the shift operating member 56*a* in order to switch the travel direction of the vessel body between the forward travel direction and the rearward travel direction. Specifically, the shift operating member 56*a* is allowed to be operated and set in one of the shifted positions of the forward travel position, the rearward travel position, and the neutral travel position. One of the unique operating signals corresponding to the shifted positions is configured to be inputted into the ECU 51. The start/stop operating device 57 for the engine 5 is a key switch, for instance, and is configured to input an operating signal into the ECU 51 in order to start or stop the engine 5.

The ECU 51 includes a recording portion 71, a calculating portion 72, and an externally outputting portion 73. The recording portion 71 is a recording device configured to write and read electronic data. The recording portion 71 stores a control program to cope with preliminarily defined operating states. The calculating portion 72 is configured to determine the current operating state based on signals from the various sensors 61 to 69 and the operating unit 52 and control actions of the ignition device 39, the fuel injector 37, and the throttle valve 38 based on the control program. Further, the ECU 51 is configured to control the shift actuator 54 based on an operating signal from the shift operating device 56. For example, the shift actuator 54 includes a driving unit such as a motor. The shift actuator 54 is configured to be controlled by the ECU 51 and is thereby configured to move the dog clutch 19 to one of the forward travel position, the rearward travel position, and the neutral travel position.

The display unit 53 is configured to display a variety of vessel-body related information detected by the various sensors 61 to 69. For example, the display unit 53 is configured to display status information of the engine 5 such as the engine speed or the engine temperature. Further, the display unit 53 is configured to display an estimated speed of the vessel body calculated by the ECU 51. For example, the recording portion 71 stores a map representing a relationship among the engine speed, the intake pressure, and the vessel body speed. The aforementioned estimated speed is calculated based on the map.

The detection signals and the operating signals inputted into ECU 51 from the operating unit 52 and various sensors 61 to 69 are stored in the recording portion 71 as operational data. The externally outputting portion 73 is an interface to execute electronic data communication with external devices. The externally outputting portion 73 is configured to output the operational data stored in the recording portion 71 to the external device. As represented in FIG. 5, for instance, a terminal device 80 (e.g., a personal computer) is connected to the externally outputting portion 73 through a communication device (wired communication, wireless communication, etc.). The terminal device 80 is configured to read out the operational data stored in the recording portion 71. The terminal device 80 includes an application program for maintenance installed therein. The terminal device 80 is configured to read out the operational data based on the application program for maintenance and display the read-out data on a monitor screen thereof. A maintenance service staff can appropriately judge the state of the engine 5 with reference to the operational data displayed on the monitor screen of the terminal device 80.

The calculating portion 72 of the ECU 51 functions as a water intrusion detecting portion according to a preferred embodiment of the present invention, which is configured to detect water intrusion potential. Water intrusion potential herein indicates the potential of water intrusion into the engine 5 through the exhaust path 20 illustrated in FIG. 1. The calculating portion 72 is configured to detect water intrusion potential by determining whether or not predetermined conditions, which would indicate a potential of water intrusion into the engine 5 through the exhaust path 20, are satisfied. The predetermined conditions herein include, for example, detection of reverse rotation of the crankshaft 12. Reverse rotation of the crankshaft 12 is configured to be detected by a known structure described in, for instance, Japan Laid-open Patent Application Publication No. JP-A-2008-274970. Specifically, reverse rotation of the crankshaft 12 is detected by the detection signals from the crank angle sensor 61 and the cam angle sensor 62. In other words, the crank angle sensor 61 and the cam angle sensor 62 are examples of a reverse rotation detecting portion of a preferred embodiment of the present invention, which is configured to detect reverse rotation of the crankshaft 12. The processing by the calculating portion 72 to detect reverse rotation of the crankshaft 12 will be hereinafter explained.

The crank angle sensor 61 preferably is a magnetic sensor configured to detect passage of a plurality of protrusions 120 of the crankshaft 12 as illustrated in FIG. 5. In FIG. 5, the reference numeral 120 points to only a portion of the protrusions 120. The protrusions 120 are regularly aligned on the surface of the crankshaft 12. However, the crankshaft 12 includes a missing portion 121 on the surface thereof. The missing portion 121 does not include any protrusions 120 thereon. A pair of adjacent protrusions 120, interposing the missing portion 121 therebetween, has an interval different from that of the other pairs of adjacent protrusions 120.

The cam angle sensor 62 preferably is a magnetic sensor configured to detect passage of a plurality of protrusions 420 provided on the exhaust camshaft 42. In FIG. 5, the reference numeral 420 points to only a portion of the protrusions 420. The protrusions 420 are regularly aligned on the surface of the exhaust cam shaft 42. However, the exhaust cam shaft 42 includes a missing portion 421 on the surface thereof. The missing portion 421 does not include any protrusions 420 thereon. A pair of adjacent protrusions 420, interposing the missing portion 421 therebetween, has an interval different from that of the other pairs of adjacent protrusions 420. The crankshaft 12, the intake cam shaft 41, and the exhaust cam shaft 42 are configured to be driven in conjunction with the start of the engine 5. Accordingly, the crank angle sensor 61 is configured to detect passage of the protrusions 120 of the crankshaft 12. On the other hand, the cam angle sensor 62 is configured to detect passage of the protrusions 420 of the exhaust cam shaft 42. The crank angle sensor 61 and the cam angle sensor 62 are configured to transmit detection signals to the ECU 51.

Figure 6:
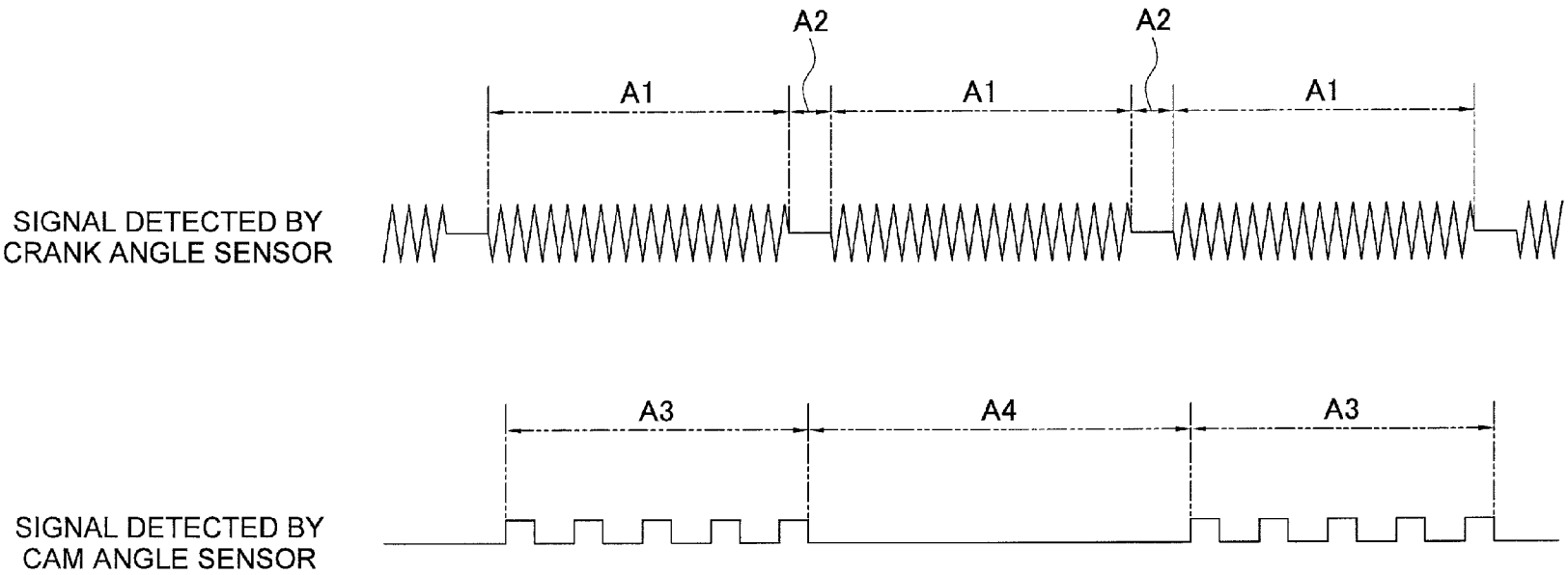
FIG. 6 is a time chart representing detection signals of a crank angle sensor and a cam angle sensor.

FIG. 6 is a time chart representing the detection signals produced by the crank angle sensor 61 and the cam angle sensor 62. When the protrusions 120 pass through the position opposed to the crank angle sensor 61, the magnetic field is strengthened and periodic oscillations are generated in the detection signal as represented in FIG. 6. When the missing portion 121 passes through the position opposed to the crank angle sensor 61, by contrast, the signal strength is kept at the same level and no periodic oscillation is generated in the detection signal. Thus, a first region A1 and a second region A2 alternately appear in the detection signal of the crank angle sensor 61. In the first region A1, a periodically oscillating signal is continued in response to passage of the protrusions 120. In the second region A2, on the other hand, a flat signal is continued in response to passage of the missing portion 121. The number of rotations and the rotational angle of the crankshaft 12 are detected through the detection of the first and second regions A1 and A2. Likewise, a third region A3 and a fourth region A4 alternately appear in the detection signal of the cam angle sensor 62. In the third region A3, a periodically oscillating signal is continued in response to passage of the protrusions 420. In the fourth region A4, by contrast, a flat signal is continued in response to passage of the missing portion 421. The number of rotations and the rotational angle of the exhaust cam shaft 42 are detected through the detection of the third and fourth regions A3 and A4.

As described above, the crankshaft 12 and the exhaust camshaft 42 are configured to be rotated in conjunction with each other. In other words, when the crankshaft 12 is rotated in a forward direction (i.e., a normal rotational direction), the first region A1 and the third region A3 appear in synchronization with each other at the same timing. In the case of the time chart of FIG. 6, one third region A3 is detected while two first regions A1 are detected. Therefore, the detection pattern of detecting one third region A3 with respect to detection of two first regions A1 is periodically repeated when the crankshaft 12 is forwardly rotated.

When rotation of the crankshaft 12 is rotated in a reverse direction (i.e., an opposite direction to the normal rotational direction), by contrast, the timing of detecting the third region A3 is different from that in the normal rotation of the crankshaft 12. Accordingly, the detection pattern of detecting the first regions A1 and the third regions A3 in reverse rotation is different from that in the normal rotation. The calculating portion 72 is configured to determine that the crankshaft 12 is reversely rotated when the first regions A1 and the third regions A3 are detected in a different detection pattern from that in the normal rotation of the crankshaft 12.

When reverse rotation of the crankshaft 12 is detected, the calculating portion 72 is configured to determine whether or not the other predetermined conditions for water intrusion potential (see Steps S1 to S3 in FIG. 7) are satisfied. For example, the water intrusion potential can be determined based on the combination of a condition of whether or not the crankshaft 12 is reversely rotated and at least one of the conditions represented in Steps S1 to S3.

In Step S1, it is determined whether or not a period of time t1 or greater has elapsed after starting of the engine 5. In other words, it is determined whether or not reverse rotation of the crankshaft 12 is detected except when the engine 5 fails to be started. Starting of the engine 5 may be determined based on a starter relay signal or a variation in battery voltage for driving a starter. Alternatively, starting of the engine 5 may be determined based on an engine starting signal configured to be outputted when an engine starter key is turned. Yet alternatively, starting of the engine 5 may be determined based on whether or not the engine speed exceeds a predetermined threshold. The processing proceeds to Step S2 when the period of time t1 or greater is elapsed after starting of the engine 5. In other words, the processing proceeds to Step S2 when reverse rotation of the crankshaft 12 is detected except when the engine 5 fails to be started.

Next in Step S2, it is determined whether or not a period of time t2 or greater has elapsed after a command of stopping the engine 5 is generated. It other words, it is determined whether or not reverse rotation of the crankshaft 12 is detected except when the engine 5 is stopped. Specifically, it is determined whether or not the period of time t2 or greater has elapsed after an operating signal for stopping the engine 5 is generated by the start/stop operating device 57 of the engine 5 and is inputted into the ECU 51. The processing proceeds to Step S3 when the period of time t2 or greater has elapsed after the command of stopping the engine 5 is generated. In other words, the processing proceeds to Step S3 when reverse rotation of the crankshaft 12 is detected except when the engine 5 is stopped.

Next in Step S3, it is determined whether or not a period of time t3 or less has elapsed after the forward/rearward travel switching portion 15 is switched into the rearward travel state. In other words, it is determined whether or not reverse rotation of the crankshaft 12 is detected within a predetermined period of time from the point in time when the forward/rearward travel switching portion 15 is switched into the rearward travel state. Specifically, the point in time when the forward/rearward travel switching portion 15 is switched into the rearward travel state is determined based on a detection signal from the shifted position sensor 69. The processing proceeds to Step S4 when the period of time t3 or less has elapsed after the forward/rearward travel switching portion 15 is switched into the rearward travel state. In other words, the processing proceeds to Step S4 when reverse rotation of the crankshaft 12 is detected within a predetermined period of time from the point in time when the forward/rearward travel switching portion 15 is switched into the rearward travel state. The point in time when the forward/rearward travel switching portion 15 is switched into the rearward travel state may be determined based on an operating signal from the shift operating device 56. In other words, it may be determined that the forward/rearward travel switching portion 15 is switched into the rearward travel state when the shift operating member 56*a* is moved to the rearward travel position.

Next in Step S4, it is determined whether or not the engine 5 is stopped. More specifically, it is determined whether or not the engine 5 is stopped after reverse rotation of the crankshaft 12 is detected. For example, it is determined that the engine 5 is stopped when a detection signal from the crank angle sensor 61 is not detected for a predetermined period of time. The processing proceeds to Step S5 when it is determined that the engine 5 is stopped. In other words, the processing proceeds to Step S5 when the engine 5 is stopped after reverse rotation of the crankshaft 12 is detected.

Next in Step S5, a detection result of water intrusion potential is recorded in the recording portion 71. More specifically, the detection result of water intrusion potential is recorded in the recording portion 71 when reverse rotation of the crankshaft 12 is detected as a condition and the predetermined conditions regarding water intrusion potential represented in Steps S1 to S3 are all satisfied. Specifically, the detection result of water intrusion potential includes the number of reverse rotations of the crankshaft 12 (also hereinafter referred to as "reverse rotation number"), the number of times of detecting water intrusion potential as of the present point in time, the total operating time as of the present point in time, the vessel speed, and logging of the engine states.

The reverse rotation number of the crankshaft 12 is a value indicating the number of reverse rotations of the crankshaft 12 until the engine 5 is stopped from the point in time when reverse rotation of the crankshaft 12 is first detected. The reverse rotation number of the crankshaft 12 is configured to be calculated based on a detection signal from the crank angle sensor 61. In the present preferred embodiment, the number of times of detecting water intrusion potential as of the present in time is a value obtained by subtracting the number of times that the predetermined conditions of Steps S1 to S3 are not satisfied from the total number of times that reverse rotation of the crankshaft 12 is detected until the present point in time.

The total operating time as of the present point in time is set as the total operating time of the engine 5 elapsed until the engine 5 is stopped after water intrusion potential is detected since the first use of the engine 5. The vessel speed may be a vessel speed at a point in time when water intrusion potential is detected, alternatively a vessel speed at a point in time when reverse rotation is detected, and further alternatively a vessel speed at a point in time when a predetermined operation that might reverse rotation is executed. It is more preferable to record a vessel speed at a point in time when the forward/rearward travel switching portion 15 is switched into the rearward travel state. Specifically, the vessel speed to be recorded is an estimated vessel speed calculated by the calculating portion 72.

The logging of the engine states is a history of the engine information until the engine 5 is stopped from a point in time earlier by a predetermined period of time t4 than the point in time when water intrusion potential is first detected. The engine information indicates the states of the engine 5 and includes the information such as the throttle opening degree, the intake pressure, the engine speed, the switched state of the forward/rearward travel switching portion 15, and the shifted position of the shift operating member 56*a*. It should be noted that the engine information is configured to be recorded in the recording portion 71 at every predetermined period of time t5 (e.g., every ten seconds) during driving of the engine 5 regardless of detection of water intrusion potential. The recording portion 71 is configured to overwrite the past engine information to update the engine information with the latest information at every predetermined period of time. When water intrusion potential is detected, the recording portion 71 is configured to store the engine information in the aforementioned period of time without erasing the engine information by overwriting it. For example, at a point in time when water intrusion potential is detected, the recording portion 71 stores both the currently recorded engine information and the engine information until the engine 5 is stopped from the point in time when water intrusion is detected without overwriting the engine information as the logging of the engine states.

Next in Step S6, the display unit 53 displays an alarm message. The alarm message is of a type of alarm to notify an operator of the detection of water intrusion potential. Therefore, the display unit 53 is an example of a notifying portion according to a preferred embodiment of the present invention configured to notify detection of water intrusion potential. It should be noted that the display unit 53 may be configured to display different types of alarm messages in accordance with the reverse rotation number of the crankshaft 12. Alternatively, the display unit 53 may be configured to display different types of alarm messages in accordance with the number (i.e., frequency) of detections of reverse rotation of the crankshaft 12.

It should be noted that water intrusion potential is not detected when the predetermined conditions of water intrusion potential of Steps S1 to S3 are not satisfied. Further, the processing proceeds to Step S7 when it is determined that the engine 5 is not being stopped in Step S4.

In Step S7, it is determined whether or not the reverse rotation number of the crankshaft 12 exceeds a predetermined threshold N. More specifically, it is determined whether or not the reverse rotation number of the crankshaft 12 exceeds the predetermined threshold N after reverse rotation of the crankshaft 12 is detected. The processing proceeds to Step S8 when the reverse rotation number of the crankshaft 12 exceeds the predetermined threshold N after reverse rotation of the crankshaft 12 is detected. By contrast, the processing returns to Step S4 when the reverse rotation number of the crankshaft 12 does not exceed the predetermined threshold N.

In Step S8, detection results regarding water intrusion potential are recorded, including a detection result that the reverse rotation number exceeds an upper limit, instead of the detection result of the reverse rotation number of the crankshaft 12 to be recorded in Step S5. The detection results to be recorded in Step S8 further include the number of times of detecting water intrusion potential as of the present point in time, the total operating time as of the present point in time, the vessel speed, and logging of the engine states. However, these detection results regarding water intrusion potential are basically the same as those to be recorded in Step S5. Therefore, explanation thereof will be hereinafter omitted.

The marine propulsion device 1 according to the present preferred embodiment preferably includes the following features.

When water intrusion potential is detected, the detection result is recorded in the recording portion 71. In turn, the detection result regarding water intrusion potential recorded in the recording portion 71 is allowed to be outputted to an external device through the externally outputting portion 73. For example, the terminal device 80 (e.g., a personal computer) is connected to the externally outputting portion 73 through a communication device (wired communication, wireless communication, etc.). With reference to the detection results regarding water intrusion potential, a maintenance service staff can appropriately judge the engine states regarding water intrusion potential through the monitor screen of the terminal device 80. Therefore, repair and inspection can be executed while the engine 5 is in a normal condition. Breakage or damage of the engine 5 can thereby be prevented.

The predetermined conditions of water intrusion potential include, for example, detection of reverse rotation of the crankshaft 12. Therefore, it is possible to accurately detect a state with a higher water intrusion potential.

The predetermined conditions of water intrusion potential include that reverse rotation of the crankshaft 12 is detected except when the engine 5 fails to be started. When the engine 5 fails to be started, reverse rotation of the crankshaft 12 may be detected. In this case, however, chances are low that water intrusion actually occurs. Therefore, detection errors can be prevented without detecting water intrusion potential when reverse rotation is detected but the engine 5 fails to be started.

The predetermined conditions of water intrusion potential include that reverse rotation of the crankshaft 12 is detected except when the engine 5 is stopped. When the engine 5 is stopped, reverse rotation of the crankshaft 12 may be detected. In this case, however, chances are low that water intrusion actually occurs. Therefore, detection errors can be prevented without detecting water intrusion potential when reverse rotation is detected but when the engine 5 is stopped.

The predetermined conditions of water intrusion potential include that reverse rotation of the crankshaft 12 is detected within a predetermined period of time from the point in time when the forward/rearward travel switching portion 15 is switched into the rearward travel state. Chances are high that water intrusion actually occurs when reverse rotation is detected within a predetermined period of time from the point in time when the forward/rearward travel switching portion 15 is switched into the rearward travel state. Therefore, water intrusion potential can be accurately detected.

When the engine 5 is stopped after reverse rotation is detected, the detection result to be recorded is the reverse rotation number of the crankshaft 12 until the engine 5 is stopped from the point in time when reverse rotation is first detected. Accordingly, the engine states can be appropriately determined.

When the reverse rotation number of the crankshaft 12 exceeds a predetermined threshold, the detection result that the reverse rotation number of the crankshaft 12 exceeds the upper limit is recorded even if the engine 5 is not stopped after reverse rotation is detected. Reverse rotation of the crankshaft 12 may be continued when the forward/rearward travel switching portion 15 is in the rearward travel state, for instance, where the vessel body is forwardly moved by a plurality of marine propulsion devices or where the vessel body including the marine propulsion device 1 is forwardly moved while being tugged by another vessel. In this case, chances are high that water intrusion actually occurs even when the engine 5 is not stopped after reverse rotation is detected. Therefore, the engine states can be appropriately determined by causing the recording portion 71 to record the detection results regarding water intrusion potential, including the detection result that the reverse rotation number of the crankshaft 12 exceeds the upper limit, as described above.

Second Preferred Embodiment

Figure 8:
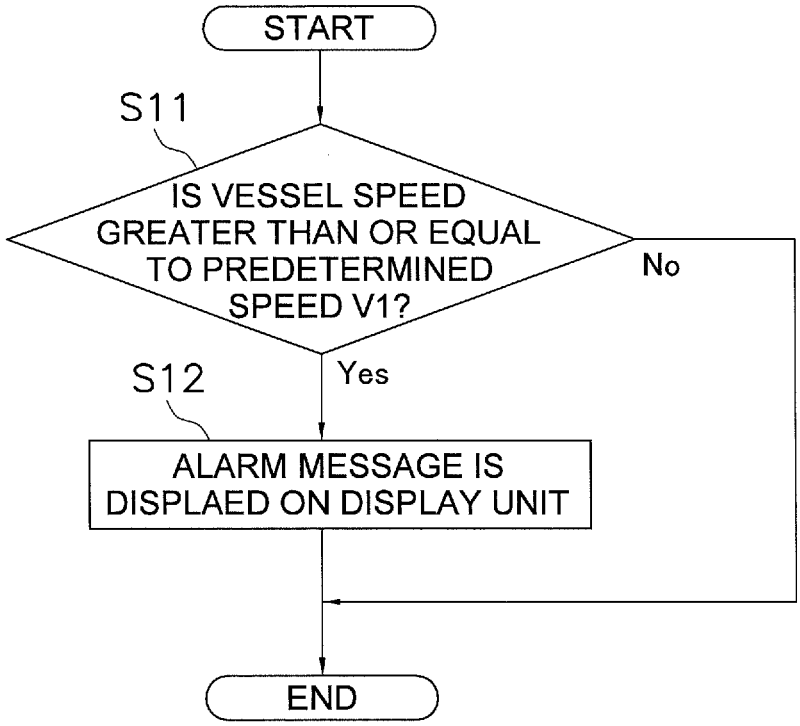
FIG. 8 is a flowchart representing a processing of detecting a state of being prone to water intrusion.

Next, a second preferred embodiment of the present invention will be hereinafter explained. The structure of a marine propulsion device of the second preferred embodiment is similar to the marine propulsion device 1 of the first preferred embodiment. In the marine propulsion device of the second preferred embodiment, the calculating portion 72 of the ECU 51 is configured to detect a state of being prone to water intrusion into the engine 5 through the exhaust path 20. FIG. 8 is a flowchart representing a processing of detecting the water intrusion prone state.

First, in Step S11 it is determined whether or not the vessel speed is greater than or equal to a predetermined speed V1. An estimated vessel speed calculated by the calculating portion 72 is herein used as the vessel speed. The calculating portion 72 is configured to determine that the water intrusion prone state is produced when the vehicle speed is greater than or equal to the predetermined speed V1. Next, in Step S12 the calculating portion 72 causes the display unit 53 to display an alarm message. The alarm message is a type of message for providing notification of information of operations that cause an increase in a possibility of water intrusion. Specifically, the alarm message is a type of message for alerting an operator not to shift the shift operating member 56*a* to the rearward travel position. The alarm message is not displayed on the display unit 53 when the vessel speed is not greater than or equal to the predetermined speed V1 in Step S11.

In the marine propulsion device 1 according to the second preferred embodiment, the alarm message is configured to be displayed on the display unit 53 when the water intrusion prone state is detected. An operator is alerted by the alarm message of the display unit 53, and can avoid shifting the shift operating member 56*a* to the rearward travel position. Accordingly, water intrusion into the engine Scan be prevented, and breakage or damage of the engine 5 can be thereby prevented.

Other Preferred Embodiments

First and second preferred embodiments of the present invention have been described above. However, the present invention is not limited to the preferred embodiments described above, and a variety of changes can be herein made without departing from the scope of the present invention.

Figure 7:
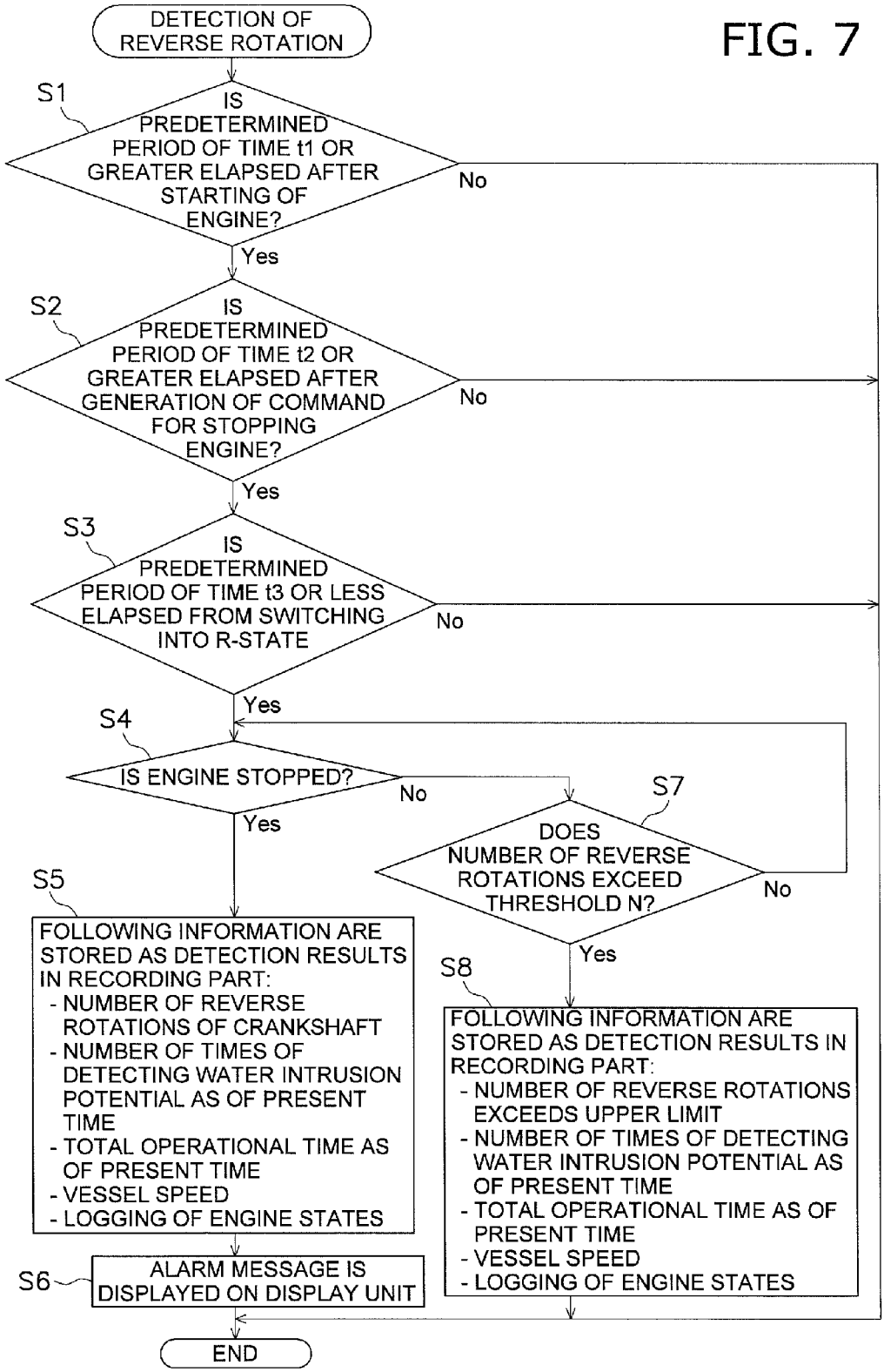
FIG. 7 is a flowchart representing a processing of detecting water intrusion potential.

In the first preferred embodiment, the predetermined conditions of water intrusion potential preferably include detection of reverse rotation of the crankshaft 12 and the aforementioned respective conditions in Steps S1 to S3 (see FIG. 7). However, the predetermined conditions of water intrusion potential may not include one or more of the aforementioned conditions, or alternatively, may include other conditions except for the aforementioned conditions. Further, a moisture detection sensor may be disposed in the exhaust manifold 40 as a water intrusion detecting portion. Even without the moisture detection sensor, water intrusion potential can be also determined based on detection of reverse rotation of the crankshaft 12 and the respective conditions in Steps S1 to S3 as described in the first preferred embodiment.

In the first preferred embodiment, the recording portion 71 is preferably configured to record an estimated vessel speed calculated by the calculating portion 72. When a vessel speed sensor configured to detect a vessel speed is connected to the ECU 51, the recording portion 71 may be configured to record a vessel speed detected by the vessel speed sensor. Alternatively, the recording portion 71 may be configured to record a vessel speed calculated based on positional information from a GPS (Global Positioning System). Further in the second preferred embodiment, either the vessel speed detected by the aforementioned vessel speed sensor or the vessel speed calculated based on the aforementioned positional information from a GPS may be used as the vessel speed in the determination condition of Step S11.

In the first preferred embodiment, the recording portion 71 is configured to record the engine information until the engine 5 is stopped from a point in time earlier by the period of time t4 than the point in time when water intrusion potential is first detected. Alternatively, the recording portion 71 may be configured to record the engine information until the engine 5 is stopped from a point in time earlier by the period of time t4 than the point in time when reverse rotation of the crankshaft 12 is first detected. Alternatively, the recording portion 71 may be configured to record the engine information within a predetermined period of time earlier than the point in time when water intrusion potential is first detected. Alternatively, the recording portion 71 may be configured to record the engine information from a point in time earlier by a predetermined period of time than the point in time when water intrusion potential is first detected to a point in time later by a predetermined period of time than the point in time when water intrusion potential is first detected. Yet alternatively, the recording portion 71 may be configured to record the engine information from a point in time earlier by a predetermined period of time than the point in time when reverse rotation of the crankshaft 12 is first detected to a point in time later by a predetermined period of time than the point in time when reverse rotation of the crankshaft 12 is first detected.

In the first preferred embodiment, the recording portion 71 is preferably configured to record the reverse rotation number of the crankshaft 12. Alternatively, the recording portion 71 may be configured to record the reverse rotation number of the flywheel 48 instead of the reverse rotation number of the crankshaft 12.

In the first preferred embodiment, the total operating time of the engine 5 from the first use of the engine 5 to the stop of the engine 5 is recorded as the time-related detection result regarding water intrusion potential. Alternatively, the total operating time of the engine 5 from the first use of the engine 5 to detection of reverse rotation of the crankshaft 12 may be recorded. The total operating time of the engine 5 is configured to be counted and recorded by a unit of a predetermined period of time (e.g., ten minutes). However, a period of time that the crankshaft 12 is reversely rotated may be shorter than the counting/recording unit. Therefore, the margin of error is small in the total operating time of the engine 5 to be recorded as the time-related detection result regarding water intrusion potential, even if either is selected from detection of reverse rotation of the crankshaft 12 and the point in time when the engine 5 is stopped as the final point in time for counting the total operating time of the engine 5. Yet alternatively, the recording portion 71 may be configured to record the date and time when reverse rotation of the crankshaft 12 is detected as the time-related detection result regarding water intrusion potential.

The notification by the notifying portion is not limited to the alarm message to be displayed on the display unit 53 as described in the aforementioned preferred embodiments. For example, the notification may be any suitable display such as an alarm lamp or sign. The notification by the notifying portion may be acoustically appealing such as a buzzer or a voice, instead of the visual notification. Further, detection of water intrusion potential may be notified using different types of notifications such as display of a message, lighting of a lamp, sounding a buzzer, and sounding a voice in accordance with the frequency of detections of reverse rotation of the crankshaft 12. For example, a checkup alarm for the engine 5 may be configured as the notification by using display of a message, lighting of a lamp or the like when frequency of detections of reverse rotation of the crankshaft 12 is less than a predetermined frequency N1. By contrast, a checkup alarm for the engine 5 may be configured as the notification by continuously sounding a buzzer or a voice when the frequency of detections of reverse rotation of the crankshaft 12 is greater than or equal to the predetermined frequency N1.

Similarly, detection of water intrusion potential may be notified using different types of notifications in accordance with the total reverse rotation number of the crankshaft 12. For example, a checkup alarm of the engine 5 may be configured as the notification using display of a message, lighting of a lamp or the like when the total reverse rotation number of the crankshaft 12 is less than a predetermined rotation number N2. By contrast, a checkup alarm for the engine 5 may be configured as the notification by continuously sounding a buzzer or a voice when the total reverse rotations number of the crankshaft 12 is greater than or equal to the predetermined rotation number N2.

The externally outputting portion 73 may be configured to output electronic data containing the aforementioned detection results of water intrusion potential to a recording medium such as a nonvolatile memory and not to the terminal device 80.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A marine propulsion device comprising:

an engine;

a propeller;

a drive shaft configured to transmit a driving force from the engine to the propeller;

an exhaust path allowing an exhaust air from the engine to pass therethrough;

a water intrusion possibility determining portion programmed to detect a water intrusion potential indicating a possibility of water intrusion into the engine through the exhaust path; and a recording portion programmed to record a detection result of the water intrusion possibility determining portion.

2. The marine propulsion device according to claim 1, further comprising:

a reverse rotation detecting portion; wherein the engine includes a crankshaft;

the reverse rotation detecting portion is configured to detect a reverse rotation of the crankshaft;

the water intrusion possibility determining portion is programmed to detect the water intrusion potential by determining whether or not a predetermined condition is satisfied, the predetermined condition indicating the possibility of water intrusion into the engine through the exhaust path; and the predetermined condition includes a condition that the reverse rotation of the crankshaft is detected by the reverse rotation detecting portion.

3. The marine propulsion device according to claim 2, wherein the predetermined condition further includes a condition that the reverse rotation of the crankshaft is detected by the reverse rotation detecting portion except when the engine fails to be started.

4. The marine propulsion device according to claim 2, wherein the predetermined condition further includes a condition that the reverse rotation of the crankshaft is detected by the reverse rotation detecting portion except when the engine is stopped.

5. The marine propulsion device according to claim 2, further comprising:

a forward/rearward travel switching portion configured to switch between a forward travel state and a rearward travel state, the forward travel state transmitting a rotation of the drive shaft to the propeller to rotate the propeller in a forward travel direction, the rearward travel state transmitting the rotation of the drive shaft to the propeller to rotate the propeller in a rearward travel direction; wherein the predetermined condition further includes a condition that the reverse rotation of the crankshaft is detected by the reverse rotation detecting portion within a predetermined period of time after a point in time when the forward/rearward travel switching portion is switched into the rearward travel state.

6. The marine propulsion device according to claim 2, wherein the recording portion is configured to record the number of reverse rotations of the crankshaft after a point in time when the reverse rotation of the crankshaft is detected by the reverse rotation detecting portion until the engine is stopped.

7. The marine propulsion device according to claim 2, wherein the recording portion is configured to record that the number of reverse rotations of the crankshaft exceeds an upper limit when the number of reverse rotations of the crankshaft exceeds a predetermined threshold after the reverse rotation of the crankshaft is detected by the reverse rotation detecting portion.

8. The marine propulsion device according to claim 2, further comprising:

a notifying portion configured to notify a detection of the water intrusion potential by the water intrusion possibility determining portion; wherein the notifying portion is configured to provide a different type of notification based on the number of reverse rotations of the crankshaft.

9. The marine propulsion device according to claim 1, further comprising a notifying portion configured to notify a detection of the water intrusion potential by the water intrusion possibility determining portion.

10. The marine propulsion device according to claim 9, wherein the notifying portion is configured to provide a different type of notification based on the number of detections of the water intrusion potential.

11. The marine propulsion device according to claim 1, wherein the recording portion is configured to record the number of detections of the water intrusion potential.

12. The marine propulsion device according to claim 1, wherein the recording portion is configured to record a time when the water intrusion potential is detected by the water intrusion possibility determining portion.

13. The marine propulsion device according to claim 12, wherein the time when the water intrusion potential is detected is a total operating time since the engine is used for the first time.

14. The marine propulsion device according to claim 1, wherein the recording portion is configured to record a vessel speed at a point in time when the water intrusion potential is detected by the water intrusion possibility determining portion.

15. The marine propulsion device according to claim 2, wherein the recording portion is configured to record a vessel speed at a point in time when the reverse rotation of the crankshaft is detected by the reverse rotation detecting portion.

16. The marine propulsion device according to claim 1, further comprising:

a forward/rearward travel switching portion configured to switch between a forward travel state and a rearward travel state, the forward travel state transmitting a rotation of the drive shaft to the propeller to rotate the propeller in a forward travel direction, the rearward travel direction transmitting the rotation of the drive shaft to the propeller to rotate the propeller in a rearward travel direction; wherein the recording portion is configured to record a vessel speed at a point in time when the forward/rearward travel switching portion is switched into the rearward travel state.

17. The marine propulsion device according to claim 1, wherein the recording portion is configured to record a state of the engine within a predetermined period of time earlier than a point in time when the water intrusion potential is first detected by the water intrusion possibility determining portion.

18. The marine propulsion device according to claim 1, wherein the recording portion is configured to record a state of the engine until the engine is stopped after a point in time earlier by a predetermined period of time than a point in time when the water intrusion potential is first detected by the water intrusion possibility determining portion.

19. The marine propulsion device according to claim 1, wherein the recording portion is configured to record a state of the engine until the engine is stopped from a point in time earlier by a predetermined period of time than a point in time when the reverse rotation of the crankshaft is first detected by the reverse rotation detecting portion.

20. A marine propulsion device comprising:

an engine;

a propeller;

a drive shaft configured to transmit a driving force from the engine to the propeller;

an exhaust path allowing an exhaust air from the engine to pass therethrough;

a water intrusion possibility determining portion programmed to detect a state of being prone to water intrusion into the engine through the exhaust path; and a notifying portion programmed to perform a notifying action in accordance with a detection result by the water intrusion possibility determining portion.

21. The marine propulsion device according to claim 20, wherein the water intrusion possibility determining portion is programmed to determine the state of being prone to water intrusion when a vessel speed is greater than or equal to a predetermined speed.

22. The marine propulsion device according to claim 20, wherein the notifying portion is configured to notify information of an operation that causes an increase in a possibility of the water intrusion.

* * * * *